US010933305B2

(12) United States Patent
Udo et al.

(10) Patent No.: US 10,933,305 B2
(45) Date of Patent: Mar. 2, 2021

(54) GEOMETRIC CONSTRUCTION PANEL

(71) Applicant: LAL-LAL INC., Fukuoka (JP)

(72) Inventors: Takako Udo, Fukuoka (JP); Hiroshi Udo, Fukuoka (JP)

(73) Assignee: LAL-LAL Inc.

( * ) Notice: Subject to any disclaimer, the term of this patent is extended or adjusted under 35 U.S.C. 154(b) by 0 days.

(21) Appl. No.: 16/628,025

(22) PCT Filed: Dec. 27, 2017

(86) PCT No.: PCT/JP2017/047122
§ 371 (c)(1),
(2) Date: Jan. 1, 2020

(87) PCT Pub. No.: WO2019/008796
PCT Pub. Date: Oct. 1, 2019

(65) Prior Publication Data

US 2020/0215425 A1 Jul. 9, 2020

(30) Foreign Application Priority Data

Jul. 3, 2017 (JP) ..... JP2017-130736

(51) Int. Cl.

| | |
|---|---|
| ***A63H 33/08*** | (2006.01) |
| ***A63F 9/12*** | (2006.01) |
| ***A63H 33/06*** | (2006.01) |
| *A63F 9/08* | (2006.01) |

(52) U.S. Cl.
CPC ..... *A63F 9/12* (2013.01); *A63H 33/065* (2013.01); *A63H 33/08* (2013.01); *A63H 33/084* (2013.01); *A63F 9/088* (2013.01); *A63F 2009/0846* (2013.01); *A63F 2009/124* (2013.01); *A63H 33/088* (2013.01)

(58) Field of Classification Search
CPC ..... A63H 33/04; A63H 33/06; A63H 33/065; A63H 33/08; A63H 33/086
See application file for complete search history.

(56) References Cited

U.S. PATENT DOCUMENTS

| | | | | |
|---|---|---|---|---|
| 3,562,077 A | | 2/1971 | Raba | |
| 3,895,229 A | | 7/1975 | Strom | |
| 4,055,019 A | | 10/1977 | Harvey | |
| 4,874,341 A | * | 10/1989 | Ziegler | A63H 33/08 446/109 |
| 5,273,477 A | * | 12/1993 | Adams, Jr. | A63H 33/08 446/108 |
| 6,453,973 B1 | | 9/2002 | Russo | |

(Continued)

*Primary Examiner* — John A Ricci

(57) ABSTRACT

A panel and a system for use in building a lightweight structure are provided. The panel, made of a film or a sheet capable of being curved or bent with fingers, includes a body in a geometric shape circumscribed by straight or curved edges, and at least one joint formation along the edge for panel connection. The joint formation has tabs separated by at least one gap. Each tab expands bilaterally and proximally from the body at its base, and each gap is positioned along the edge so as to accept the base of the tab. The joint formations along the edges of varied curvatures are alignedly, hingedly, and detachably interlocked with each other by twisting the panels with fingers to individually hook the tab at the gap. The panels are assembled into geometric structures having flat or curved faces.

10 Claims, 7 Drawing Sheets

(56) References Cited

U.S. PATENT DOCUMENTS

| | | | | |
|---|---|---|---|---|
| 8,845,381 | B2 * | 9/2014 | Ziegler | A63H 33/08 446/108 |
| 2003/0162473 | A1 * | 8/2003 | Yang | A63H 33/08 446/108 |
| 2005/0287906 | A1 | 12/2005 | He | |
| 2017/0340981 | A1 * | 11/2017 | Iliovits | A63H 33/086 |

* cited by examiner

GEOMETRIC CONSTRUCTION PANEL

TECHNICAL FIELD OF THE INVENTION

The present invention relates to panels for use in building lightweight structures.

BACKGROUND OF THE INVENTION

A panel made of a planar and simpler material is ideal for building a lightweight structure such as a geometric puzzle, model, and ornament. The panel is light, compact, easily manufactured, and convenient for assembly and disassembly without requirement of tools or other elements. Thinner panels reduce the weight of the structure and are suitable for creating different shapes with flat or curved surfaces by curving or bending. However, the shape and usage of the assembled structure have been largely limited due to their joints. The joints are relatively fragile and the structures easily come apart when dropped. Curvature generates significant strains and makes the structure even more unstable or unable to form. Practically, closed geometric structures are useful for many applications, but they are mostly polyhedra with flat surfaces and also vulnerable to impacts.

BRIEF SUMMARY OF THE INVENTION

According to one aspect of the present invention, a panel for use in building a geometric structure is provided. The panel is made of a substantially planar and flexible material, namely, a film or a sheet having a thickness of from 0.10 to 0.75 mm and a weight per area of from 0.01 to 0.15 g/cm$^2$ and capable of being curved and bent with human fingers. The panel includes: a body having a geometric shape circumscribed by a plurality of edges, each of the edges being either a line segment or an arc; and at least one joint formation placed along some of or all of the edge. The joint formation has of a plurality of tabs spaced apart by at least one gap. Each of the tabs is integral with the body, has its base along the edge, protrudes out from the body at the base, expands bilaterally and proximally from the base at an angle of more than 0 and less than 75 degree, and has no overlaps between the tabs. Each of the gaps is a part of the edge and also an interval between the adjacent bases. A length of the base and a length of the gap along an outline of the edge are substantially equal within ±10%. A position of the gap along the outline of the edge inversely corresponds to a position of one of the bases along the outline of the edge when inverted relative to a midpoint of the edge. Therefore, the joint formations along the edges of varied curvatures are alignedly, hingedly, and detachably interlocked with each other by twisting the panels to individually hook the tabs at the gaps. The flat, curved, or bent panel is used to build the structure.

According to another aspect of the present invention, a system for use in building a two- or three-dimensional geometric structure is provided. The system includes at least one panel, made of a substantially planar and flexible material, namely, a film or a sheet capable of being curved and bent with human fingers. The panel include: a body having a geometric shape circumscribed by a plurality of edges, each of the edges being either a line segment or an arc; and at least one joint formation placed along some of or all of the edges. The joint formation has a plurality of tabs spaced apart by at least one gap. Each of the tabs is integral with the body, has a base along the edge, protrudes out from the body at the base, expands bilaterally and proximally from the base at an angle of more than 0 and less than 75 degree, and has no overlaps between the tabs. Each of the gaps is a part of the edge and also an interval between the adjacent bases. A length of the base and a length of the gap along an outline of the edge are substantially equal within ±10%. A position of the gap along the outline of the edge inversely corresponds to a position of one of the bases along the outline of the edge when inverted relative to a midpoint of the edge. Therefore, the joint formations along the edges of varied curvatures are alignedly, hingedly, and detachably interlocked with each other by twisting the panels with the fingers to individually hook the tabs at the gaps. The flat, curved, or bent panel is used to build the structure.

DETAILED DESCRIPTION OF THE INVENTION

The panels of this invention allow one to build a variety of lightweight geometric structures. The structure is assembled without requirement of tools or connecting elements. The panel is made of a substantially planar and flexible material, which can be curved or bent with human fingers to form flat or curved surfaces of the structure. The panels are joined by twisting with the fingers. The joint formations along straight or curved edges mediate panel connection in alignment. A resulting hinge enables angle adjustments around the straight or curved edge as a rotation axis. Each tab is manipulated individually, serving as a fundamental unit of connection. Therefore, the edge is joined gradually with a light force of fingers, enabling to make a difficult connection that requires a substantial force. This system increases the relative strength of panel connection, improves tolerance against strains of curved surfaces or impacts of falling, and expands buildable shapes of geometric structures with well-defined faces, edges, and vertices. Connected panels are readily separated by twisting with the fingers, and will be reused.

Figure 1:
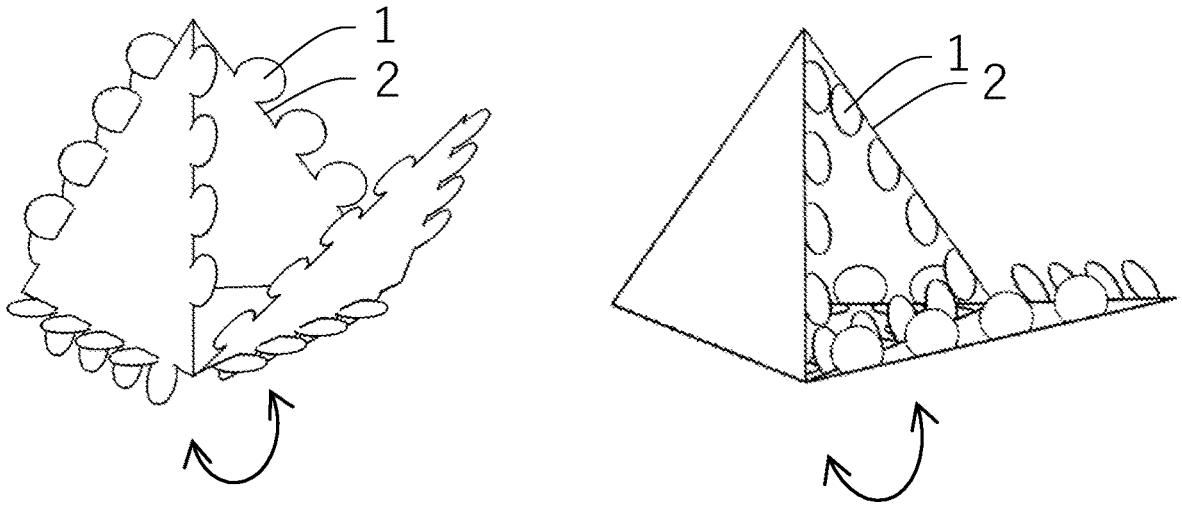
FIG. 1 is a perspective view of constructing structures with the panels.

FIG. 1 shows an exemplary view of building a structure. The panel is made of a film or sheet having optimal resilience and rigidity, allowing for curving and bending with human fingers. The body of the panel has a closed two-dimensional geometric shape circumscribed by a plurality of edges, each edge being a line segment (straight edge) or an arc (smoothly curved edge). The panel has at least one joint formation, provided for some of or all of the edges. The joint formation is located along the straight or curved edge, and consists of a plurality of tabs 1 spaced apart by at least one gap 2. Each of the tabs 1 is integral with the body, having its base along the edge, protruding out from the body at the base, expanding bilaterally and proximally from the base. Each of the gaps 2 is a part of the edge and also an interval between two adjacent tabs at the bottom. Panel connection is mediated via the joint formations, creating a hinge along the shared edge. The panel angle is adjustable around the shared edge as a rotation axis. The joint formations may be placed either inside or outside of the structure depending on one's preference.

Figure 2:
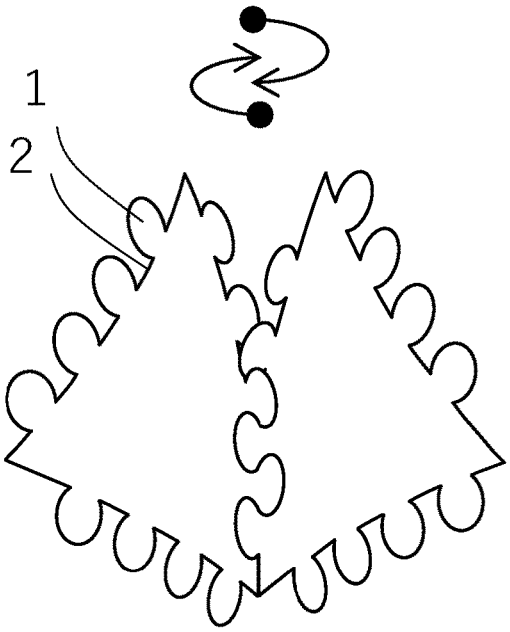
FIG. 2 is a perspective view of connecting two panels by twisting.

Panel connection is made by twisting, not by inserting the panels. As illustrated in FIG. 2, by twisting the panels, let the tab of one panel pass through between the tabs of the other panel and then hook the base of the tab at the gap. This is easily performed at fingertip. An alternative way is to align the edges of two panels (see FIG. 8), pinch adjacent tabs with left and right fingers, and then twist these tabs to interlock each other. By repetition, two edges are joined, and a hinge is formed. Each tab is manipulated individually, and panel connection is achieved gradually or sequentially. The tab, like a lever, is useful to connect panels by applying a light force with the fingers. This is advantageous for panel connection that requires a significant force. A partial connection of the edge can be made as well.

Figure 3:
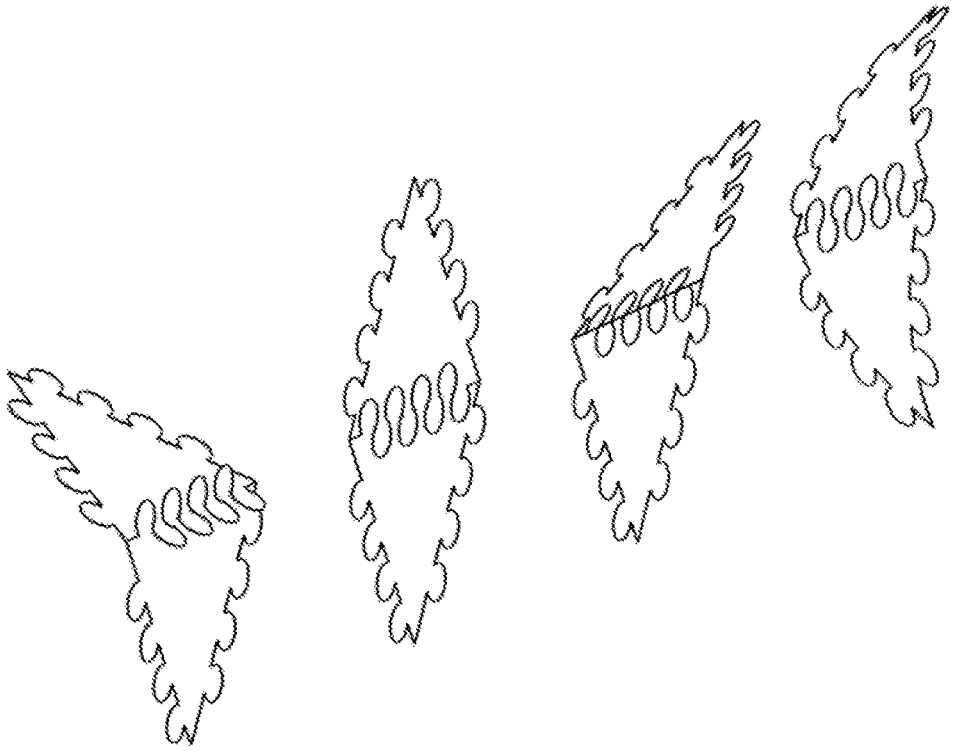
FIG. 3 is a perspective view of connected panels at angles, bent, or curved along the shared edge.

As illustrated in FIG. 3, the panels are joined in alignment without a noticeable space between the edges. The panel angle is freely adjustable around the shared edge as a rotation axis. The working range of the panel angle is extended by bending the tabs along the edge. Without bending, the resilience of the tabs helps create a smoothly curved surface.

Figure 4:
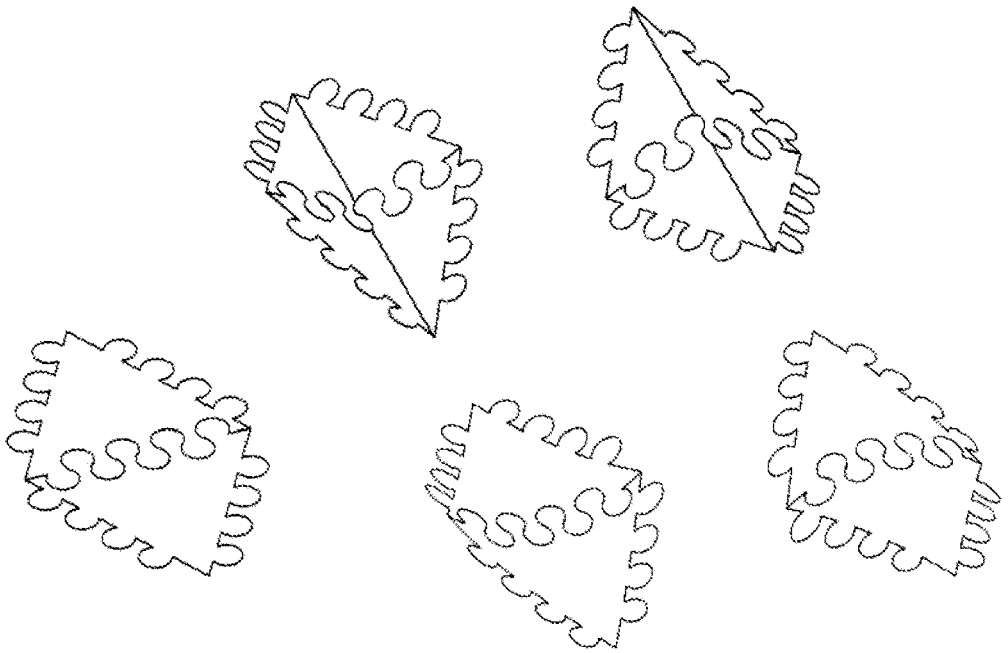
FIG. 4 is a perspective view of connected panels bent, or curved across the shared edge.

As illustrated in FIG. 4, the connected panels may be bent or curved across the shared edge without separation. In this case, it is preferable to bend panels by crossing the side of the base.

Figure 5:
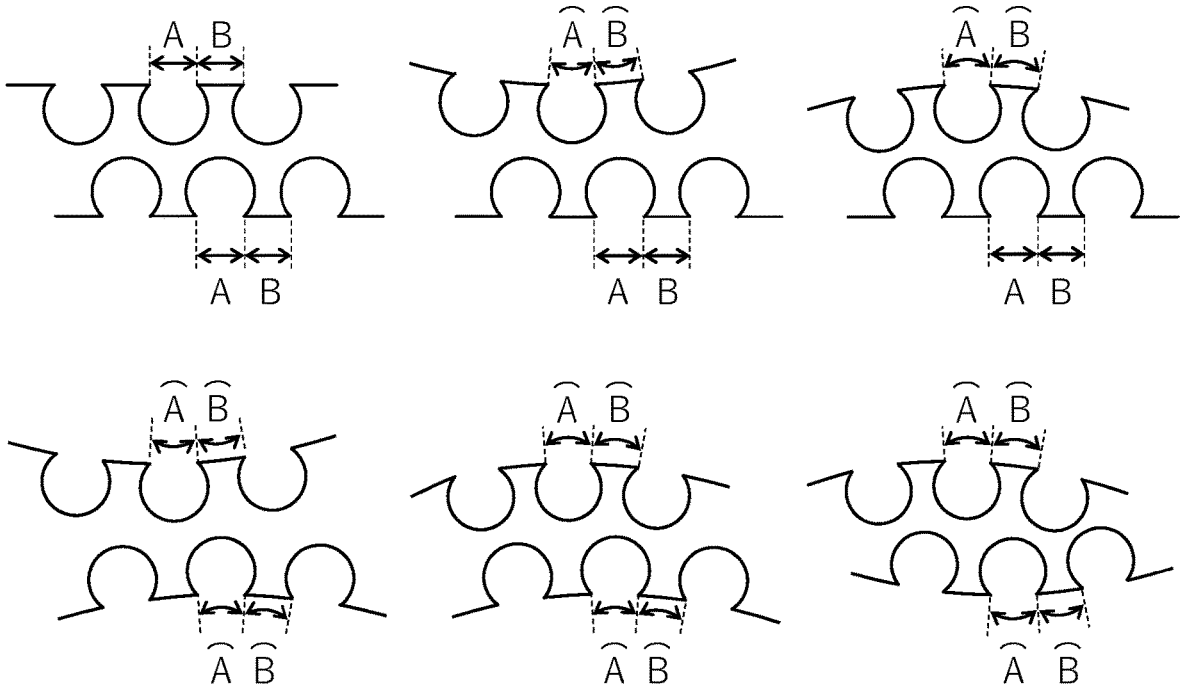
FIG. 5 illustrates connections of two edges with same or different curvatures.

As illustrated in FIG. 5, two edges of different curvatures are connected in alignment without forming a noticeable space. A straight-to-straight edge connection (top left), straight-to-curve edge connections (top center and top right), and curve-to-curve edge connections (bottom) are made possible. For the straight-to-straight edge connection, the panel faces remain flat, and the dihedral angle is adjusted. For the straight-to-curve and curve-to-curve edge connections, the panel faces often curve, and the panel angle is still adjustable within a limited range.

It is easy to separate the panels with the fingers, by twisting the panels in the opposite direction. The interlocked tabs will be sequentially disjoined from one end to the other without being torn apart. The separated panels are reusable.

The tab expands bilaterally and proximally from its base so as to hook each other via press-contacts at their bases. And, the tabs do not overlap each other so as to ease manufacturing. Therefore, the tab is not limited to a round shape. The gap is a part of the edge and an interval between the adjacent bases. Since the edge serves as a rotation axis to adjust panel angles, the edge so as the gap must be straight or smoothly curved, without a sudden change in the edge curvature. A length of the base (A) and a length of the gap (B) must be measured along the outline of the edge.

Figure 6:
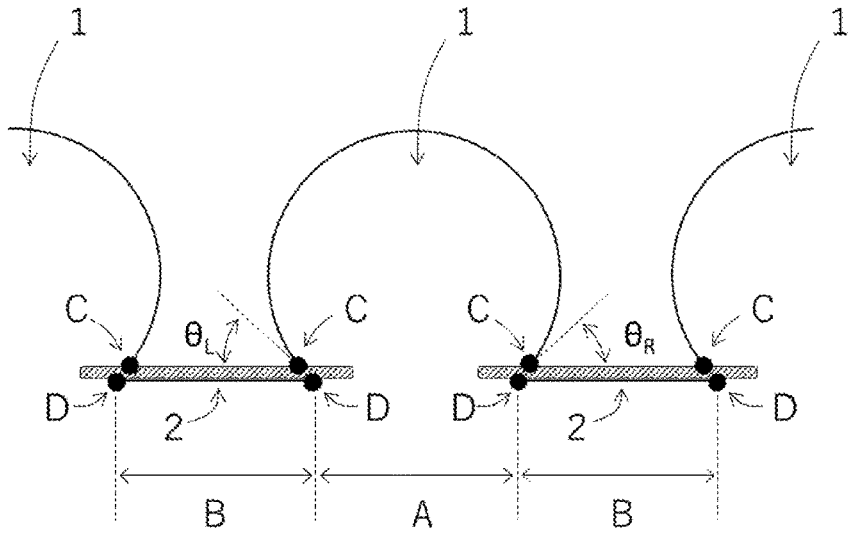
FIG. 6 is an enlarged side view of two joint formations interlocked orthogonally.

FIG. 6 is an enlarged view of two joint formations connected orthogonally. The tabs 1 are hooked at hook points C. The tabs 1 join to the body at base points D. Although these points are in close proximity, the hook point C is critical for both interlock and angle adjustment. The tab expands bilaterally and proximally from its base with an included angle θ between tangential lines of the tab and the edge at the hook point. θ at the left and right sides of the base ($\theta_L$ and $\theta_R$) is more than 0 and less than 75 degree. If θ is over 75 degree, panel connection is weaker for convex-curved edges and also for a highly flexible panels (reduced press-contacts). Note that the base point D may be rounded within a range of the panel thickness to prevent crack formations (microscopically, the angle at the base point may exceed 90 degree).

The length of the base (A) along the outline of the edge is a length between two adjacent base points D along the outline of the edge. The length of the gap (B) along the outline of the edge is a length between two adjacent base points D along the outline of the edge. The length of the base (A) and the length of the gap (B) along the outline of the edge are substantially equal within ±10%, so as to tightly fit the base at the gap. This is required for making edge-to-edge connections without forming a noticeable space, even if two edges are different in shapes (see also FIG. 5). The length between two hook points C at the gap is slightly less than the length of the gap, but the base of the tab will fit into the gap due to the flexibility. However, narrower gaps cause tabs to curve, and wider gaps cause tabs to loose-fit. Therefore, depending on the flexibility or thickness of the material, the length of the base (A) and the length of the gap (B) may be adjusted. If the panel is thinner or softer, the length of the gap (B) may be narrowed up to 10% to improve joint strength. If the panel material is thicker or harder, the length of the gap (B) may be widened up to 10% to ease angle adjustment and to avoid damages at the base.

Figure 7:
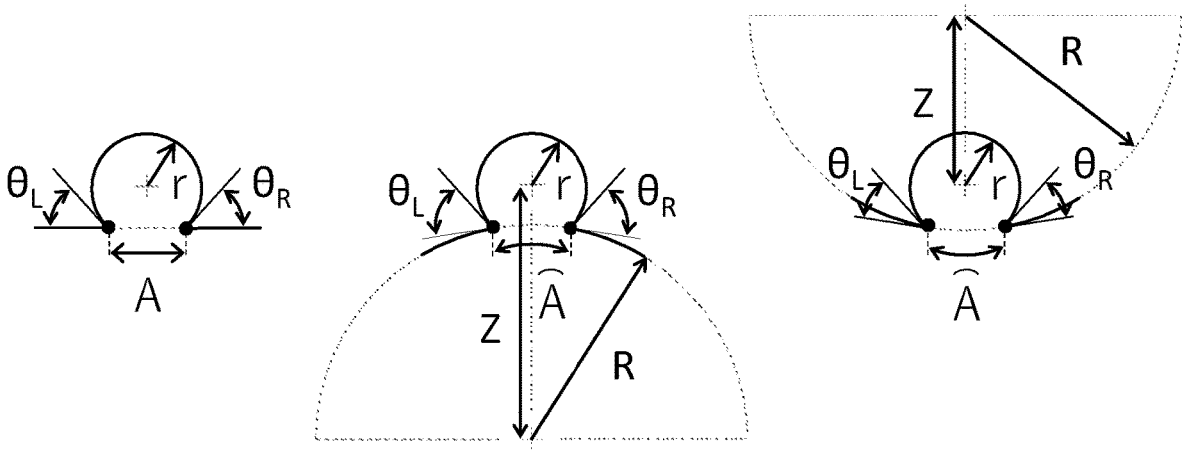
FIG. 7 illustrates designing of the tabs along the edge of varied curvatures.

FIG. 7 shows an example of designing the joint formation. To simplify, the tab is round, and the panel thickness is not considered. r is a radius of the tab, R is a radius of the edge curvature, Z is a distance between the two centers, and W is an edge length. The length of the base (A) should satisfy two conditions: 1) $0° < \theta < 75°$, no overlaps between the tabs, 2) at least one gap per edge in a symmetrical arrangement as described later ($A \leq W/4$).

For the straight edge, θ and condition 1 are as follows (Math 1, 2, and 3). If r is 3 to 30 mm, A will be 3 to 57.9 mm from condition 1. If W is 50 mm, A will be 3 to 12.5 mm with condition 2. Find a preferable A by considering the size and usage of the structure, as it affects the number of the tabs per edge. Note that placing more tabs per edge improves tolerance against strains or impacts (e.g. four tabs per edge).

$$\theta = (180°/\pi)\arcsin(A/2r) \quad \text{[Math 1]}$$

$$30° < \theta < 75° \quad \text{[Math 2]}$$

$$r < A < 1.932r \quad \text{[Math 3]}$$

For the edge of convex arc, θ and condition 1 are as follows (Math 4, 5, and 6).

$$\theta=(180°/\pi)\arccos[(Z^2-r^2-R^2)/2rR] \quad \text{[Math 4]}$$

$$(180°/\pi)\arccos[\tfrac{1}{2}\sin(A/2R)-R/r]<\theta<75° \quad \text{[Math 5]}$$

$$R\arcsin[r/(r+R)]<A<2R\arctan(r/R) \quad \text{[Math 6]}$$

For the edge of concave arc, θ and condition 1 are as follows (Math 7, 8, and 9).

$$\theta=(180°/\pi)\arccos[(r^2+R^2-Z^2)/2rR] \quad \text{[Math 7]}$$

$$(180°/\pi)\arccos[R/r-\tfrac{1}{2}\sin(A/2R)]<\theta<75° \quad \text{[Math 8]}$$

$$R\arcsin[r/\sqrt{(r^2+R^2)}]<A<2R\arcsin(r/R) \quad \text{[Math 9]}$$

Figure 8:
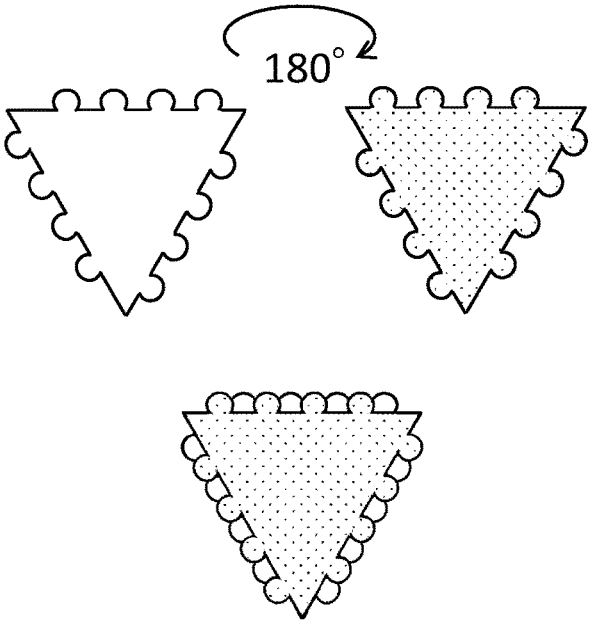
FIG. 8 is an example of symmetrical arrangement of the joint formations along the edge.

The position of the gap along the outline of the edge inversely corresponds to the position of one of the bases along the outline of the edge when inverted relative to a midpoint of the edge. By this, two edges of the same length should join perfectly in alignment regardless of straight or smoothly curved edges. This also allows a partial or full arrangements of tabs along the edge. Furthermore, symmetric and uniform arrangements of joint formations enhance versatility in connections. FIG. 8 shows an example of arranging the joint formations in rotational symmetry for the regular triangular panel (one tab at the end of the edge is lacking). When the inverted panel is overlaid on top of the original panel, the position of each gap corresponds to the position of one of the bases.

Figure 19:
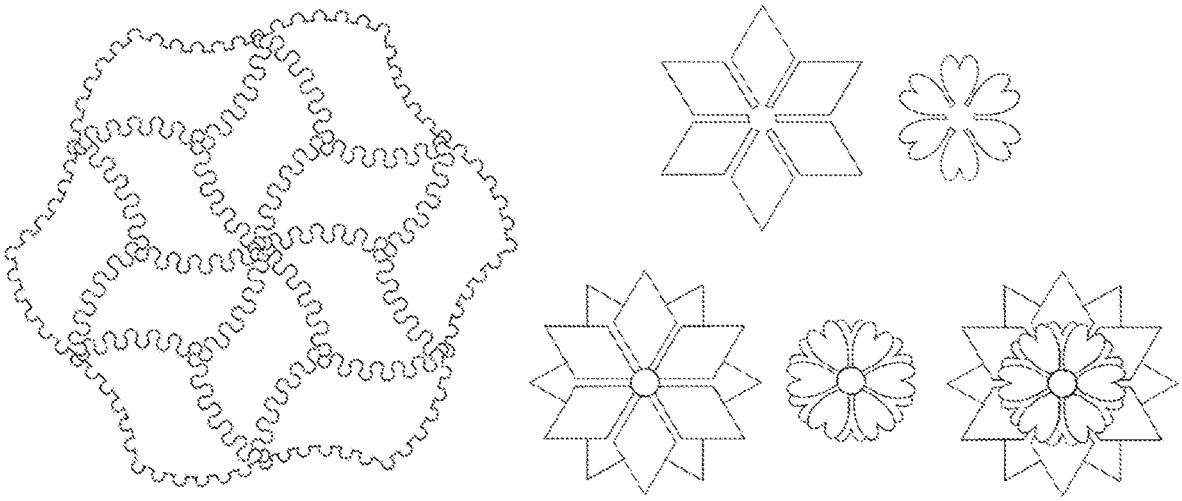
FIG. 19 is an example of two-dimensional structures built with the unit-type panels.

The size and shape of the tabs are designed freely, as long as the tabs have a constant base length, bilateral and proximal expansion from the base, and no overlaps with each other. To ease handling and to minimize steric hindrance, horizontal and vertical sizes of the tab are preferably more than 5 mm and less than one-third of the edge length. The shape of the tab may be bilaterally symmetric and smooth-edged (e.g. circular and elliptical shapes). Face-to-face connections, being less affected by steric hindrance, give more freedom in the size and shape of the tabs (see also FIGS. 8 and 19).

The tabs facilitate handling with the fingers and also serve for decoration. In case of steric hindrance, the tabs may be bent along the edge, positioned inside or outside of the structure, or cut off by removing the upper portion while leaving the bottom portion for hook (keep the length about 5 to 10 times of the panel thickness from the edge). Placing the tab at the edge terminal is optional, as it is prone to steric hindrance (see FIG. 9). However, implementing the terminal tab prevents potential formation of a space at the vertex surrounded by convex-curved surfaces due to the resilience (see FIG. 13).

The panels are either unit- or net-types. The unit-type panel has a basic geometrical shape, and a plurality of such panels are used to build the structure. The net-type panel has a net-like shape, which is curved or bent to build the structure. The unit-type panels are capable of creating a variety of shapes, while the net-type panels facilitate to form predetermined shapes.

The body is a closed two-dimensional geometrical shape. The body of unit-type panels may be a polygon from a triangle to a dodecagon, in which each of the edges is either a line segment or an arc. A combination of such geometrical shapes may serve as the body of net-type panels. The unit-type panels with higher symmetry are more versatile. Mirror-symmetric shapes allow overlaid connections (see FIGS. 8 and 19). It is preferable to use defined edge lengths or angles. Some structures like triclinic crystals require several distinct panels with lower degrees of symmetry.

The panel may have crease lines to facilitate bending. The crease lines are one-dimensional shape consisting of line segments or an arcs.

The panel may have apertures or slits. Apertures and slits are useful in approximating non-developable surface, fastening, hanging, or decorating the structures.

Curved surfaces formed are mostly developable surfaces such as cylinders, cones, and tangent developables. Non-developable surfaces are only roughly approximated (see FIG. 14). An attempt to doubly curve the panel in two orthogonal axes only leads to a formation of singly curved surfaces around the corner areas while the center area remains about flat. To refine approximation, the unit-type panel may have an elongated shape in the direction to be curved, or the net-type panel may have apertures or slits in the direction to be curved (see FIG. 17).

The panel is made of a substantially planar and flexible material. It should be hard enough to hold the assembled structure, as well as soft enough to allow curving or bending with the fingers. Avoid using brittle materials. Papers may be used. For repeated use, plastics are preferable. Plastics may be processed (e.g. compounding, physical finishing, metalizing, printing, and coating), or combined with other materials (e.g. paper, wood slice, thin fabric or leather, and metal foil) by means of lamination or adhesive bonding. Synthetic papers and functional films (e.g. color films, fluorescence films, phosphorescence films, vapor-deposited films, mirror films, dichroic films, polarizing films, holographic films, lenticular films, and liquid crystal films) significantly change the texture and appearance of the structure.

The panel is preferably 0.10 to 0.75 mm in thickness, when common plastics are used. Thicker panels are harder to bend or curve with the fingers, while excessively thinner panels yield frail structures. Some plastics (e.g. polyethylene) are very flexible, but, as they thicken, soon it becomes hard to manipulate with the fingers. In one experiment, an icosahedron made of polyethylene terephthalate films (0.10 mm in thickness, 20 regular triangular panels of 3 cm in edge length) was 1.3 g in weight (60 $cm^3$ in volume, 6 cm in diameter), standing still, squashable with a finger, but tolerant to ten trials of 1-m free fall to a wooden floor, and withstood a suspension when loaded with 80 g of glass beads. An icosahedron made of polypropylene sheets (0.75 mm in thickness, 20 regular triangular panels of 40 cm in edge length) was 1,180 g in weight (140,000 $cm^3$ in volume, 76 cm in diameter), standing still, and tolerant to ten trials of 1-m free fall. The structures made of thinner panels retain sufficient stability relative to the weight.

To obtain lightweight structures, a weight per area of the panel is preferably 0.01 to 0.15 $g/cm^2$. Although specific gravities of plastics are generally 0.9 to 1.7 $g/cm^3$, lamination with a metal foil, for example, adds weight. Lighter panels are compact, portable, and also economical. For manufacturing, the body and joint formation of the panel may be integrally processed. Depending on applications, employ suitable methods including die-cutting, punching, laser-processing, and injection molding.

The panel serves different applications. The panels are assembled into different shapes, which may be used as a construction toy, an educational material of geometry, a model for designing or art, and a decorative ornament. The structure is lightweight and stable, which may be used as a container, a package, and a hanging ornament. It may be also used as a lampshade for a LED lighting apparatus. The panels are connected in layers and allow insertion of a planar material (e.g. a flattened flower), which may be used as an accessory, bookmark, and coaster.

The panels may be provided in the form of a kit for the convenience of users. The kit includes a set of panels in combinations. For example, a kit for regular polyhedra may include the panels of regular polygons. The kit may also include other elements or apparatuses depending on applications.

According to one aspect of the invention, a joint system is provided. The system comprises at least one panel made of a substantially planar and flexible material capable of being curved or bent with human fingers. The system allows one to build two- or three-dimensional lightweight structures having flat or curved surfaces. The joint formations on straight or curved edges enable edge-to-edge connections in alignment with sufficient stability. The tabs are individually manipulated by applying a light force with the fingers. The panels are readily separated by twisting and may be reused.

Embodiments

The following embodiments of the present invention include but are not limited to the described material, configuration, method, and application. The panels were primarily made of a polyethylene terephthalate film at about 0.2 mm in thickness. The panel shape, including the body and joint formation, was designed by a computer. The material was processed with a laser cutting device. The tab used were mostly circular at 3.5 mm in radius, and the lengths of the base and gap were 5 mm along the outline of straight or curved edges. For regular polygons, the edge length was 50 mm and had 4 or 5 tabs per edge (with or without the terminal tab). The arc curvature was mostly 50 mm in radius. Under these conditions, an included angle at the base and a percentage of the tab overlaps were 45.6° and 19.3% for the straight edge, 48.4° and 16.2% for the convex arc edge, and 42.7° and 22.9% for the concave arc edge, respectively. The weight per area was 0.023 g/cm$^2$, which was about one-sixth of commercially available panels with similar sizes. An icosahedron assembled from 20 regular triangular panels having 5 cm in edge length was 7 g in weight (9.5 cm in circumspheric diameter, 273 cm$^3$ in volume). The structure remained intact after 10 trials of 1-m free fall to a wooden floor, and also withstood a load of 420 g glass beads when suspended. Similarly, a truncated dodecahedron assembled from 20 regular triangular panels and 12 regular decagonal panels having 5 cm in edge length was 63 g in weight (30 cm in circumspheric diameter, 10,630 cm$^3$ in volume). The structure did not come part even after 10 trials of 1-m free fall, although an easily fixable dent was formed at the vertex twice.

The provided embodiments include examples of 1) structures assembled from the panels having straight or curved edges, 2) structures assembled from the panels having same or different edge lengths and angles, 3) structures assembled from the panels having joint formations along some of or all of the edges, 4) structures of convex or concave polyhedra, 5) structures having flat or curved faces, 6) structures built with the unit-type or net-type panels, 7) structures assembled from the panels by bending or curving, and 8) two- or three-dimensional structures.

Figure 9:
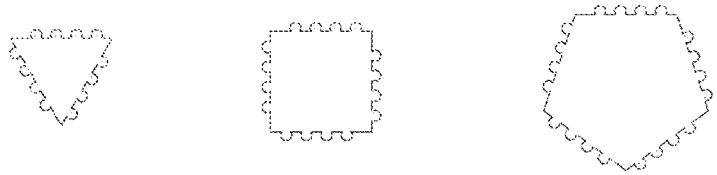
FIG. 9 is an example of the unit-type panels in the shape of regular polygons.
Figure 10:
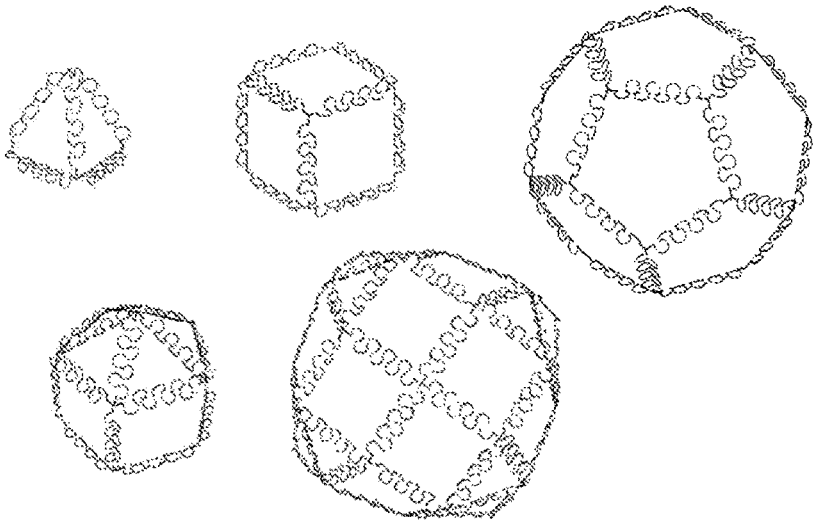
FIG. 10 is an example of the structures built with the panels of regular polygons.

Convex polyhedra were assembled from regular polygonal panels. FIG. 9 illustrates an example of the panels in the shape of a regular triangle, a square, and a regular pentagon. The joint formations are provided along the edges in rotational symmetry. Platonic solids and deltahedra are made of a single type of regular polygons, such as a tetrahedron (4 regular triangles), a cube (6 squares), and a dodecahedron (12 regular pentagons) at the top of FIG. 10. Archimedean solids, uniform prisms and antiprisms, and Johnson solids require several types of regular polygons. At the bottom left, an elongated pentagonal pyramid (5 regular triangles, 5 squares, 1 regular pentagon) is shown. Goldberg solids, when assembled with regular polygons, produce curved faces. At the bottom right, a tetravalent Goldberg solid of Q=5 (8 regular triangles, 24 squares; Fujita et al., (2016)) is shown.

Figure 11:
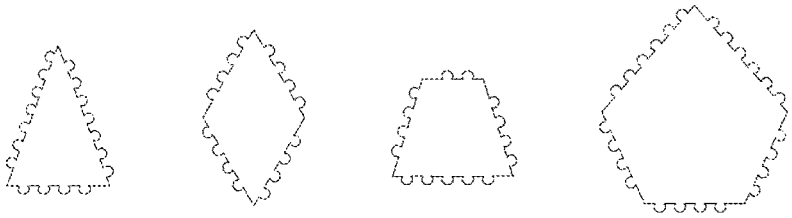
FIG. 11 is an example of the unit-type panels in the shape of irregular polygons.
Figure 12:
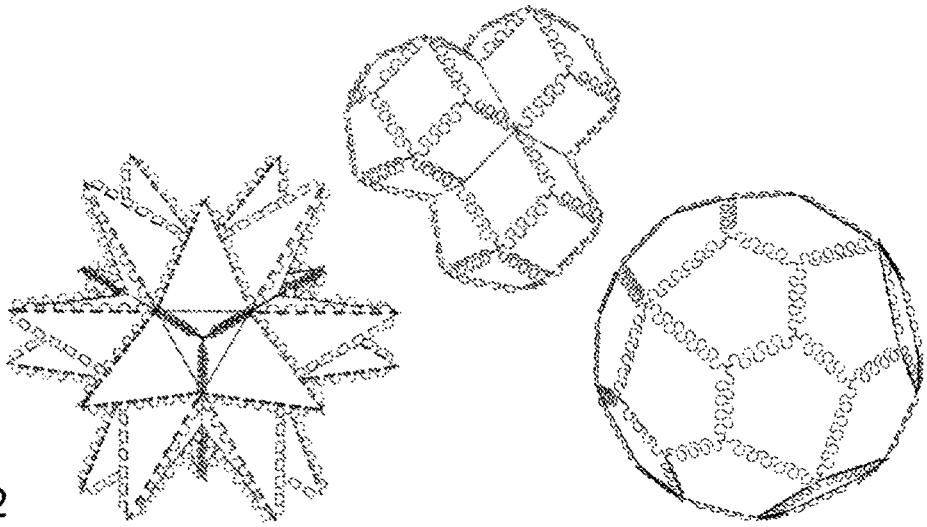
FIG. 12 is an example of the structures built with the panels of irregular polygons.

The unit-type panels having different interior angles or edge lengths were used to construct convex or concave polyhedral structures. FIG. 11 illustrates an example of the panels of an isosceles triangle, a rhombus, a trapezoid, and an irregular pentagon. Such irregular polygons are required for the structures such as Keplar-Poinsot solids, Catalan solids, space-filling solids, and crystals. As shown in FIG. 12, a great stellated dodecahedron (60 isosceles triangles, a Keplar-Poinsot solid), a combination of a trapezo-rhomboic dodecahedron (6 rhombuses and 6 trapezoids, a space-filling solid), and a pentagonal icositetrahedron (24 irregular pentagons, a Catalan solid) were assembled. In these structures, the tabs at the valleys were placed inside.

Figure 13:
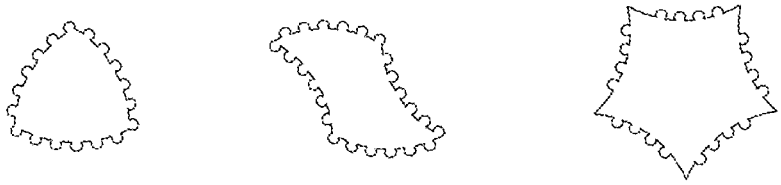
FIG. 13 is an example of the unit-type panels having curved edges.
Figure 14:
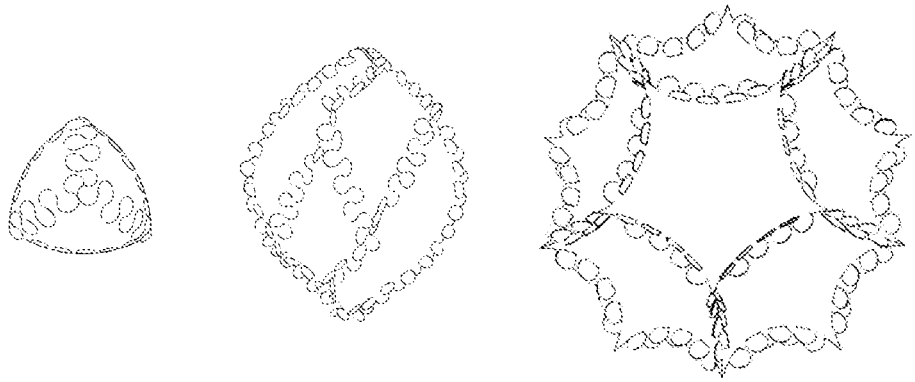
FIG. 14 is an example of the structures built with the panels having curved edges.

The unit-type panels having concave or convex arcs were used to construct structures having curved faces. The edges of varied curvatures are joined in alignment. FIG. 13 shows an example of the panels in the shape of a triangle with convex arc edges, a rhombus with convex or concave arc edges, and a pentagon with concave arc edges. As shown in FIG. 14, the structures resembling a Reuleaux tetrahedron (4 panels, convex-to-convex connection), a rhombic polyhedron-like solid (10 panels, convex-to-convex, convex-to-concave, and concave-to-concave connections), and a parabolic dodecahedron (12 panels, concave-to-concave connection) were assembled from such panels, respectively. The ideal structures have doubly curved or non-developable surfaces, which were approximated with curved faces about flat in the center and singly curved in the peripheries. These structures possessed significant strains from curved surfaces, but readily withstood multiple 1-m free falls.

Figure 15:
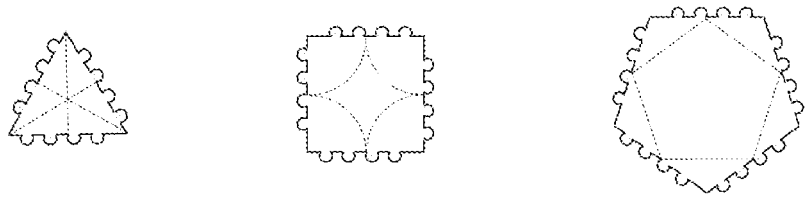
FIG. 15 is an example of the unit-type panels having crease lines.
Figure 16:
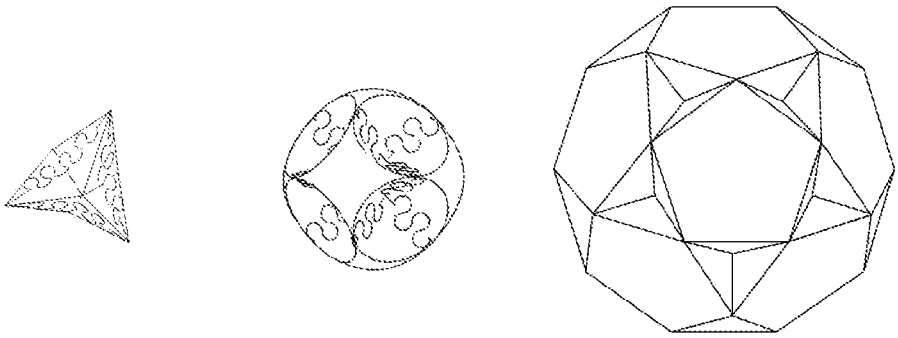
FIG. 16 is an example of the structures built with the panels bent along the crease lines.

Rectilinear or curvilinear bending of the panels creates flat or curved faces of the structure. Bending across the edge is possible. FIG. 15 shows the panels of a regular triangle with linear crease lines, a square with curvilinear crease lines, and a regular pentagon with straight crease lines. FIG. 16 illustrates three structures assembled from 4, 6, and 12 pieces of such panels, respectively, being bent along the crease lines. The structure in the middle has smoothly curved surfaces with cone-shaped dents. The structure on the right has its tabs inside.

Figure 17:
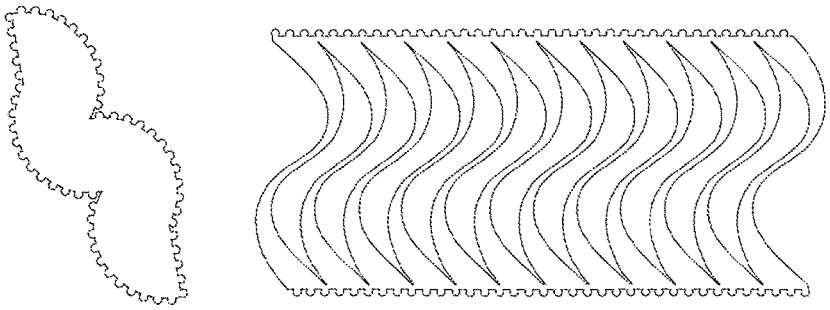
FIG. 17 is an example of the net-type panels.
Figure 18:
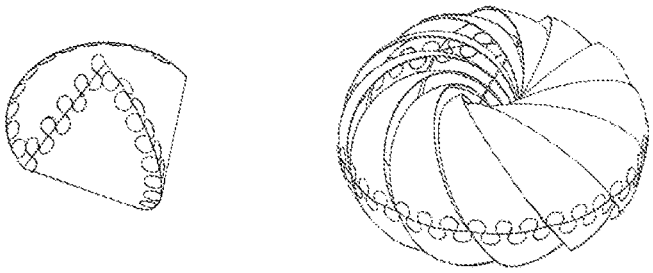
FIG. 18 is an example of the structures built with the net-type panels.

The net-type panels are useful to build structures in predetermined shapes. This is an example of building the curved structures. FIG. 17 shows two net-type panels, in which one has a shape of combined four sectors and the other has a complex shape having multiple sigmoidal apertures in the direction of curvatures to be formed (joint formations in some edges). By connecting the edges with the tabs inside of the structure and without bending the tabs, a smooth curvature is formed around the shared edge. FIG. 18 shows the structures resembling a Sphericon and Clifford torus, assembled from such panels (for convenience, some tabs located inside of the structure are visualized in the figure). The former has a developable surface, while the latter has a non-developable surface and was approximated by introducing apertures to the panel.

The unit-type panels were used to build two-dimensional structure. The panel enables both horizontal and layered connections to create a variety of geometric patterns. As an example of horizontal connection, FIG. 19 on the left shows a regular tessellation using the panels of the arc-edged rhombus (see FIG. 13). As an example of layered connection, two panels having the tabs of different sizes and shapes around the round body (the upper right) were connected face-to-face in combinations (lower right, 2-, 2-, and 4-layers, respectively). By bending the tabs, these two-dimensional patterns transformed into three-dimensional structures like flowers.

REFERENCE NUMERALS

1. a tab
2. a gap
A. a length of the base along the outline of the edge (with an arc symbol for curved edges)
B. a length of the gap along the outline of the edge (with an arc symbol for curved edges)
C. a hook point
D. a base point
θ. an included angle between the tab and the edge at the hook point
$\theta_L$. θ at the left hook point of the base
$\theta_R$. θ at the right hook point of the base
r. a radius of the round tab
R. a radius of edge curvature at the base
Z. an interval between the centers of two circles

The invention claimed is:

1. A panel for use in building a geometric structure, made of a substantially planar and flexible material, namely, a film or a sheet having a thickness of from 0.10 to 0.75 mm and a weight per area of from 0.01 to 0.15 g/cm$^2$ and capable of being curved and bent with human fingers, the panel comprising:

a body having a geometric shape circumscribed by a plurality of edges, each of the edges being either a line segment or an arc; and at least one joint formation placed along some of or all of the edges, and consisting of a plurality of tabs spaced apart by at least one gap, each of the tabs being integral with the body, having a base along the edge, protruding out from the body at the base, expanding bilaterally and proximally from the base at an angle of more than 0 and less than 75 degree, and having no overlaps between the tabs, and each of the gaps being a part of the edge and also an interval between the adjacent bases, wherein a length of the base and a length of the gap along an outline of the edge are substantially equal within ±10%, and a position of the gap along the outline of the edge inversely corresponds to a position of one of the bases along the outline of the edge when the positon of the gap along the outline of the edge is inverted relative to a midpoint of the edge;

wherein the joint formations along the edges of varied curvatures are alignedly, hingedly, and detachably interlocked with each other by twisting the panels with the fingers to individually hook the tabs at the gaps, and the flat, curved, or bent panel is used to build the structure.

2. The panel according to claim 1, wherein the panels having mirror-symmetric and congruent bodies are connected face-to-face and allow insertion of a substantially planar element in between.

3. The panel according to claim 1, wherein an upper portion of the tab is configured to be cut off by leaving a bottom portion for hooking.

4. The panel according to claim 1, wherein the geometric shape of the body is a polygon or a combination of the polygons, the polygon being from a triangle to a dodecagon circumscribed by the plurality of edges, each of the edges being either the line segment or the arc.

5. The panel according to claim 1, wherein the panel has a plurality of crease lines for bending.

6. The panel according to claim 1, wherein the panel has at least one aperture or slit for use in approximation of non-developable surfaces, fixing, hanging, or decoration.

7. The panel according to claim 1, wherein the material is the film or the sheet of plastics or processed plastics including a functional film and a synthetic paper.

8. The two- or three-dimensional structure built with the panel of claim 1, the structure being a geometric puzzle, a model, a container, and a decorative article.

9. A kit to assemble the structure of claim 8.

10. A system for use in building a two- or three-dimensional geometric structure, the system comprising at least one panel made of a substantially planar and flexible material, namely, a film or a sheet capable of being curved and bent with human fingers, the panel comprising:

a body having a geometric shape circumscribed by a plurality of edges, each of the edges being either a line segment or an arc; and at least one joint formation placed along some of or all of the edges, and consisting of a plurality of tabs spaced apart by at least one gap, each of the tabs being integral with the body, having a base along the edge, protruding out from the body at the base, expanding bilaterally and proximally from the base at an angle of more than 0 and less than 75 degree, and having no overlaps between the tabs, and each of the gaps being a part of the edge and also an interval between the adjacent bases, wherein a length of the base and a length of the gap along an outline of the edge are substantially equal within ±10%, and a position of the gap along the outline of the edge inversely corresponds to a position of one of the bases along the outline of the edge when the positon of the gap along the outline of the edge is inverted relative to a midpoint of the edge;

wherein the joint formations along the edges of varied curvatures are alignedly, hingedly, and detachably interlocked with each other by twisting the panels with the fingers to individually hook the tabs at the gaps, and the flat, curved, or bent panel is used to build the structure.

* * * * *